US005361597A

United States Patent [19]

Hazime et al.

[11] Patent Number: 5,361,597

[45] Date of Patent: Nov. 8, 1994

[54] THERMOSTATIC EXPANSION VALVE

[75] Inventors: Tanaka Hazime, Yokohama; Masamichi Yano, Tokyo; Tetsuro Ikoma, Kawasaki, all of Japan

[73] Assignee: Fuji Koki Manufacturing Co., Ltd., Tokyo, Japan

[21] Appl. No.: 230,944

[22] Filed: Apr. 21, 1994

[30] Foreign Application Priority Data

Apr. 22, 1993 [JP] Japan ..... 5-095856

[51] Int. Cl.[5] ..... F25B 41/04

[52] U.S. Cl. ..... 62/205; 62/217; 62/225; 236/92 B

[58] Field of Search ..... 62/205, 204, 222, 224, 62/225, 210, 211, 212, 217; 236/92 B

[56] References Cited

U.S. PATENT DOCUMENTS

| | | | |
|---|---|---|---|
| 2,642,724 | 6/1953 | Carter | 62/8 |
| 3,388,864 | 6/1968 | Noakes | 236/92 |
| 3,450,345 | 6/1969 | Orth et al. | 236/92 |
| 3,537,645 | 11/1970 | Treder | 236/92 |
| 3,667,247 | 6/1972 | Proctor | 62/217 |
| 3,785,554 | 1/1974 | Proctor | 62/224 X |
| 3,810,366 | 5/1974 | Orth | 62/217 |
| 3,817,053 | 6/1974 | Orth | 62/210 |
| 3,822,563 | 7/1974 | Orth | 62/217 |
| 4,065,939 | 1/1978 | Thornbery et al. | 62/217 |
| 4,344,566 | 8/1982 | Götzenberger | 62/225 X |
| 4,468,054 | 8/1984 | Orth | 285/237 R |
| 4,542,852 | 9/1985 | Orth et al. | 236/92 B |
| 4,979,372 | 12/1990 | Tanaka | 62/225 |
| 4,984,735 | 1/1991 | Glennon et al. | 62/225 X |
| 5,005,370 | 4/1991 | Tanaka et al. | 62/211 |
| 5,044,551 | 9/1991 | Tanaka et al. | 236/92 B |
| 5,060,485 | 10/1991 | Watanabe et al. | 62/225 |
| 5,127,237 | 7/1992 | Sendo et al. | 62/225 |
| 5,228,619 | 7/1993 | Yano et al. | 236/92 B |
| 5,297,728 | 3/1994 | Yano et al. | 62/225 X |
| 5,303,864 | 4/1994 | Hirota | 62/225 X |

*Primary Examiner*—Harry B. Tanner

*Attorney, Agent, or Firm*—Kenyon & Kenyon

[57] ABSTRACT

A thermostatic expansion valve includes a valve housing having upper and lower passages. In the lower passage a valve member urged by a spring toward a valve seat of a valve port formed therein is provided. At the top of the housing a driving unit for driving the valve member to open and close the port is attached. The unit has a housing partitioned by a diaphragm into upper and lower pressure operating chambers. A diaphragm driving fluid is filled in the upper chamber, and the lower chamber is connected to a refrigerant circulating pipe between an evaporator pressure regulator and a compressor while the upper passage to the pipe between an evaporator and the regulator and the lower passage to the pipe between the evaporator and an condenser. In the housing a valve member driving rod extends from the diaphragm to the port and crosses the upper passage. The top end of the rod is hermetically fixed to the diaphragm and the lower end abuts the valve member against the spring. In the rod a chamber extends from the top to a portion corresponding to the upper passage and has an opening at the top. Adsorbent or porous member is contained in the chamber. An O-ring is attached to a driving rod penetrating opening of a partition wall between the lower chamber of the unit and the upper passage.

6 Claims, 3 Drawing Sheets

THERMOSTATIC EXPANSION VALVE

BACKGROUND OF THE INVENTION

1. Field of the Invention

The present invention relates to a thermostatic expansion valve, particularly to a thermostatic expansion valve which is suitable to be used, for example in an car air conditioner not only being needed to be small and light but also being subjected to vibration, centrifugal force, acceleration and deceleration, and more particularly to a thermostatic expansion valve which is suitable to be used in combination with an evaporator pressure regulator in the car air conditioner.

2. Description of the Related Art

The thermostatic expansion valve is used in a refrigeration cycle and FIG. 3 schematically shows a structure of a well-known refrigeration cycle. In the well-known refrigeration cycle, a compressor 10, a condenser 12, a reservoir 14, a thermostatic expansion valve 16 and an evaporator 18 are connected to one another in this order by a refrigerant pipe 20. The compressor 10 compresses refrigerant gas flowing into it and send the compressed refrigerant gas to the condenser 12. In the condenser 12, the compressed refrigerant gas is changed into refrigerant liquid because heat is taken off from the compressed refrigerant gas by air blown to the condenser 12 by a fan 22. The refrigerant liquid flown out from the condenser 12 is temporarily stored in the reservoir 14 and then flows into the thermostatic expansion valve 16, by which its pressure are rapidly lowered so that its temperature is also lowered. The refrigerant liquid pressure and temperature of which has been lowered takes heat off from air around the evaporator 18 so that it is gasified in the evaporator 18 and then flows into the compressor 10.

The thermostatic expansion valve 16 has a thermal bulb **16*a* for its valve member driving unit, and the thermal bulb is in contact with the refrigerant pipe 20 just after a refrigerant outlet of the evaporator 18. Further, an external pressure equalizing pipe 16*b* extending out from the driving unit to resist gas pressure supplied from the thermal bulb 16*a* is connected to the refrigerant pipe 20 at a downstream of the thermal bulb 16*a***.

The driving unit of the thermostatic expansion valve 16 drives a valve member by a pressure difference between a pressure of gas, generated in the thermal bulb **16*a* to corresponding to the temperature of refrigerant gas flowing just after the refrigerant outlet of the evaporator 18, and a pressure of the refrigerant gas introduced from the refrigerant pipe 20 through the external pressure equalizing pipe 16*b*. In this way, the thermostatic expansion valve 16 controls the amount of the refrigerant liquid which flows into the evaporator 18. More specifically, the thermostatic expansion valve 16 increases the amount of the refrigerant liquid flowing into the evaporator 18 when heat load in the evaporator 18 is increased so that the gasifying of the refrigerant liquid in the evaporator 18 is promoted and a difference of the temperature of the refrigerant gas flowing out from the refrigerant outlet of the evaporator 18 and an evaporation temperature of the refrigerant liquid in the evaporator 18 (that is, a degree of super heat) becomes large. In contrast thereto, the thermostatic expansion valve 16 decreases the amount of the refrigerant liquid flowing into the evaporator 18 when heat load in the evaporator 18 is decreased so that the gasifying of the refrigerant liquid is not promoted in the evaporator 18 and the temperature of the refrigerant gas flowing out from the refrigerant outlet of the evaporator 18 becomes substantially equal to the evaporation temperature of the refrigerant liquid in the evaporator 18. With such an operation, heat exchange efficiency in the evaporator 18 keeps at the highest level by controlling the amount of the refrigerant liquid flowing into the evaporator 18 on the basis of the magnitude of the heat load in the evaporator 18**.

When the heat load applied to the evaporator 18 is small, moisture in the air is sometimes condensed and frosted on an outer surface of the evaporator 18. When the outer surface of the evaporator 18 is frosted, the heat exchange ability of the evaporator 18 is lowered. To prevent this, an evaporator pressure regulator 24 is attached to the refrigerant pipe 20 between the refrigerant outlet of the evaporator 18 and the refrigerant inlet of the compressor 10. The evaporator pressure regulator 24 serves to prevent an evaporation pressure of the refrigerant liquid in the evaporator 18 from becoming lower than a predetermined value so that the evaporation temperature thereof which corresponds to the evaporation pressure is prevented from becoming lower than a predetermined value and the above-mentioned frosting of moisture is prevented. The evaporator pressure regulator 24 is arranged in the refrigerant pipe 20 between the thermal bulb 16 and the pressure equalizing pipe **16*b*. With this arrangement, when the evaporator pressure regulator 24 closes the refrigerant pipe 20, the pressure difference between the pressure of the gas generated by the thermal bulb 16*a* which is positioned upstream of the evaporator pressure regulator 24, and the pressure of the refrigerant gas flowing from the external equalizing pipe 16*b* which is positioned downstream of the evaporator pressure regulator 24, is increased to make the thermostatic expansion valve 16 open. Therefore, the amount of the refrigerant liquid which flows into the evaporator 18 is increased, so that the temperature lowering of the evaporator 18** can be effectively prevented.

The above-described thermostatic expansion valve 16 having the thermal bulb **16*a*, however, is not suitable to be used in a car air conditioner because the independent thermal bulb 16*a* is connected to the thermostatic expansion valve 16 through a capillary tube. The thermal bulb 16*a* with the capillary tube makes the attachment of this thermostatic expansion valve 16 to a predetermined position in the car air conditioner in an assembly line thereof being difficult. In addition, the thermostatic expansion valve 16** is likely to be damaged because cars are susceptible at all times to vibration, centrifugal force, acceleration and deceleration.

In car air conditioners, a thermostatic expansion valve having such an arrangement as shown in FIG. 4 has been widely used. In a valve housing 30 of this thermostatic expansion valve, a first passage 32 and a second passage 34 are formed so as to be separated from each other in a vertical direction. The lower first passage 32 is arranged in a part of the refrigerant pipe 20 which extends from the reservoir 14 located downstream side of the refrigerant outlet of the condenser 12 to the refrigerant inlet of the evaporator 18 and the second passage 34 is arranged in a part of the refrigerant pipe 20 which extends from the refrigerant outlet of the evaporator 18 to the refrigerant inlet of the compressor 10.

A valve port 32*a* is formed in the first passage 32 to make the refrigerant liquid supplied from the refrigerant outlet of the reservoir 14 perform an adiabatic expansion. A center line of the valve port 32*a* extends a longitudinal direction of the valve housing 30. A valve seat is formed in an inlet of the valve port 32*a*, and a valve member 32*b* is urged toward the valve seat by urging means 32*c* such as a compression coil spring.

A valve member driving unit 36 is attached to a top of the valve housing 30. The unit 36 has a pressure-operating housing 36*d* an inner space of which is hermetically partitioned into upper and lower pressure-operating chambers 36*b* and 36*c* by a diaphragm 36*a*.

The lower pressure-operating chamber 36*c* of the pressure-operating housing 36*d* is communicated with the second passage 34 through a pressure equalizing opening 36*e* which is concentric with the center line of the valve hole 32*a*. A pressure of a refrigerant gas or vapor flowing from the refrigerant outlet of the evaporator 18 into the second passage 34 is applied to the lower pressure-operating chamber 36*c* through the equalizing opening 36*e*.

A valve member driving rod 36*f* is coaxially arranged in the equalizing opening 36*e*, and extends from a lower surface of the diaphragm 36*a* to the valve port 32*a* in the first passage 32. The valve member driving rod 36*f* is supported freely slidable in the vertical direction by an inner surface of the lower pressure-operating chamber 36*c* in the pressure-operating housing 36*d* and by a partition wall between the first and second passages 32, 34, and a lower end of the valve member driving rod 36*f* contacts the valve member 32*b*. A sealing member 36*g* is attached to a portion on an outer peripheral surface of the driving rod 36*f*, the portion corresponding to the partition wall between the first and second passages 32, 34, to prevent the refrigerant from leaking from the first passage 32 to the second passage 34 and vice versa.

Well-known diaphragm driving fluid is filled in the upper pressure-operating chamber 36*b* of the pressure-operating housing 36*d*. To the diaphragm driving fluid, the heat of the refrigerant vapor flowing from the refrigerant outlet of the evaporator 18 into the second passage 34 is transmitted through the diaphragm 36*a* and the valve member driving rod 36*f* exposed in the second passage 34 and the equalizing opening 36*e* communicated with the second passage 34.

The diaphragm driving fluid in the upper pressure-operating chamber 36*b* is gasified in response to the heat transmitted thereto and applies its pressure to an upper surface of the diaphragm 36*a*. The diaphragm 36*a* deflects in the vertical direction by a pressure difference between the pressure of the gas of the diaphragm driving fluid applied to the upper surface of the diaphragm 36*a* and a pressure applied to the lower surface of the diaphragm 36*a*. The pressure applied to the lower surface of the diaphragm 36*a* is a total of the pressure of the refrigerant vapor flowing from the refrigerant outlet of the evaporator 18 into the second passage 34, and an urging force of the urging means 32*c* applied to the valve member 32*b* in the first passage 32.

A displacement movement of the diaphragm 36*a* in the vertical direction is transmitted to the valve member 32*b* through the valve member driving rod 36*f* to make the valve member 32*b* approach or move away from the valve seat in the valve port 32*a*.

In this conventional thermal expansion valve, when the heat load in the evaporator 18 is increased and the degree of superheat (difference between a temperature of the refrigerant vapor and an evaporation temperature in the evaporator 18) of the refrigerant vapor flowing from the refrigerant outlet of the evaporator 18 into the second passage 34 is raised, the pressure difference increases in response to the rise of the degree of superheat so that the center portion of the diaphragm 36*a* is moved downward to move the valve member 32*b* away from the valve seat by the valve member driving rod 36*f*.

When the heat load in the evaporator 18 is decreased and the degree of superheat is lowered, the center portion of the diaphragm 36*a* is moved upward to allow the valve member 32*b* approach or sit on the valve seat by the urging force of the urging means 32*c*.

The conventional thermostatic expansion valve shown in FIG. 4, however, is not suitable to be used with the evaporator pressure regulator. The reason is as follows. If the evaporator pressure regulator is arranged in the refrigerant pipe 20 between the outlet of the second passage 34 of the thermostatic expansion valve and the refrigerant inlet of the compressor 10 as shown in the conventional example of FIG. 3, the pressure and temperature of the refrigerant vapor in the evaporator 18 can be prevented from lowering when the evaporation pressure of the refrigerant in the evaporator 18 is lowered to a predetermined value and the evaporator pressure regulator 24 is closed. Therefore, the pressure of the refrigerant vapor in the lower pressure-operating chamber 36*c* which corresponds to the pressure of the refrigerant vapor in the evaporator 18, and the pressure of the diaphragm driving gas in the upper pressure-operating chamber 36*b* which corresponds also to the temperature of the refrigerant vapor in the evaporator 18 are prevented at the same time from lowering, so that the difference of these both pressures is kept unchanged. The distance of the valve member 32*b* relative to the valve seat in the valve port 32*a*, therefore, is not changed greatly from that at the time when the evaporator pressure regulator starts its operation. This means that the amount of the refrigerant liquid flowing into the refrigerant inlet of the evaporator 18 through the valve port 32*a* is not changed greatly from that at the time when the evaporator pressure regulator starts its operation. Therefore, the temperature of the evaporator 18 cannot be rapidly prevented from lowering, and the frosting on the outer surface of the evaporator 18 cannot be effectively prevented.

A thermostatic expansion valve which is compact like as that shown in FIG. 4 of this application and can be used with the evaporator pressure regulator, is disclosed in FIG. 2 of U.S. Pat. No. 4,065,939 issued to Thornbery et al. In the thermostatic expansion valve, a valve member driving rod which extends from a diaphragm in a pressure-operating housing of a valve member driving unit on a top end of a valve housing to a valve member in a first lower passage and crosses a second upper passage, is hollow. This hollow portion in the valve member driving rod is closed at a bottom end thereof but opened at a top end thereof to communicate with an upper pressure-operating chamber in the pressure-operating housing.

Further, in the thermostatic expansion valve in FIG. 2 of the above described U.S. patent of Thornbery et al., a lower pressure-operating chamber in the pressure-operating housing is communicated with a refrigerant pipe through a pressure equalizing opening in downstream of an evaporator pressure regulator connected to an outlet of the second passage. In addition, a valve member driving rod penetrating opening which is formed in a partition wall between the lower pressure-operating chamber and the second passage is sealed by a combination of urging means and a sealing member both of which are arranged in the lower pressure-operating chamber.

SUMMARY OF THE INVENTION

The thermostatic expansion valve shown in FIG. 4 of this application can not operate accurately when the equalizing opening 36*e* is clogged with a foreign matter in the refrigerant and the flowing of the refrigerant vapor from the evaporator 18 into the lower pressure operating chamber 36*c* is restricted. That is, to operate this thermostatic expansion valve accurately, the temperature of the diaphragm driving fluid in the upper pressure operating chamber 36*b* of the valve member driving unit 36 must be consistent with that of the refrigerant vapor in the second passage 34.

If the above described flowing restriction of the refrigerant vapor is caused, a temperature of the refrigerant vapor in the lower pressure operating chamber 36*c* is different from that in the second passage 34.

An influence of the temperature difference to the operation of the valve member driving unit 36 becomes large as a ratio B/A becomes large, wherein A is a volume of the second passage 34 and B is a volume of the lower pressure operating chamber 36*c*, because the valve member driving rod 36*f* exposed in the lower pressure operating chamber 36*c* and in the second passage 34 transmits the temperatures of the refrigerant vapors in the both chamber 36*c* and passage 34 to the diaphragm driving fluid in the upper pressure operating chamber 36*b*.

The thermostatic expansion valve shown in FIG. 2 of the U.S. patent of Thornbery et al. is not so influenced as that in FIG. 4 of this application, because the diaphragm driving fluid in the upper pressure operating chamber can be transmitted directly with the temperature of the refrigerant vapor in the second passage via the portion of the outer surface of the valve member driving hollow rod exposed in the second passage.

In the thermostatic expansion valve of the U.S. patent of Thornbery et al., however, since the hollow driving rod is also exposed in the lower pressure operating chamber, the ratio B/A must be so small as possible to make the thermostatic expansion valve of the U.S. patent of Thornbery et al. perform more accurately even if the pressure equalizing opening is clogged with the foreign matter in the refrigerant.

The combination of the sealing member and the urging means arranged in the lower pressure operating chamber of the thermostatic expansion valve of the U.S. patent of Thornbery et al. prevents the B/A from lowering.

The thermostatic expansion valve of the U.S. patent of Thornbery et al. has another disadvantage that the expansion valve is not suitable to be used in a car air conditioner.

In order to operate accurately this expansion valve while the pressure equalizing opening is not clogged, the liquified diaphragm driving fluid must be located in an lower end of the hollow portion of the valve member driving rod. To achieve this, a hollow plug is arranged in the hollow portion. But this hollow plug can not prevent enough the liquified diaphragm driving fluid from moving out from the inner end of the hollow portion when the thermostatic expansion valve is used in a car air conditioner and is applied with various vibration, centrifugal force, acceleration and deceleration by a movement of a car accommodating the car air conditioner.

This invention is derived from the above situations, the object of this invention is to provide a thermostatic expansion valve in which the ratio B/A (wherein: A is the volume of the passage for the refrigerant vapor flowing out from the evaporator, and B is the volume of the lower pressure operating chamber located under the diaphragm in the valve body driving unit) is reduced, most of the diaphragm driving fluid which has not been gasified can be located in the passage for the refrigerant vapor under any situation, and the communication between the lower pressure operating chamber and the passage for the refrigerant vapor is sealed, so that the thermostatic expansion valve of this invention is suitable to be used in a car air conditioner not only being needed to be small and light but also being subjected to vibration, centrifugal force, acceleration and deceleration, and is suitable to be used in combination with an evaporator pressure regulator.

In order to achieve the object of this present invention, a first thermostatic expansion valve of this invention comprising: a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion; a valve member arranged in the first passage and being able to contact and separate from an opening of the valve port, the opening being located away from the second passage and being provided with a valve seat; means for urging the valve member toward the valve seat of the valve port; a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid; a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a chamber having an opening at the one end, extending in the rod to a portion thereof exposing in the second passage, and closed at its extending end; means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod and a second supporting portion which is located in the valve housing between the second passage and the first passage and supports the valve member driving rod to be freely slidable along the center line; and an adsorbent filled in the chamber in the valve member driving rod and changing an adsorbing amount of the diaphragm driving fluid in response to change in temperature thereof.

With this structure, since the chamber in which the adsorbent is filled is extended in the valve member driving rod to a portion thereof exposed in the second passage, temperature of the adsorbent can correspond to that of the refrigerant vapor flowing from the refrigerant outlet of the evaporator into the second passage. Adsorbent changes the adsorbing amount of the diaphragm driving fluid in response to the temperature thereof, thereby changing a pressure of gas generated by the diaphragm driving fluid in the space of the valve member driving unit located away from the second passage. This change of the gas pressure changes a difference between the gas pressure and the pressure of the refrigerant vapor flowing from the refrigerant outlet of the evaporator into the second passage and introduced into the space of the valve member driving unit located near to the second passage, through the equalizing opening, thereby causing a center portion of the diaphragm to be displaced. This displacement of the center portion of the diaphragm is transmitted to the valve member through the valve member driving rod to change a distance between the valve member and the valve seat of the valve port in the valve housing. As the result of this, an amount of the refrigerant liquid flowing from the refrigerant outlet of the condenser into the refrigerant inlet of the evaporator through the first passage of the valve housing is changed in response to the degree of superheat of the refrigerant vapor flowing out from the refrigerant outlet of the evaporator.

Most of the gas pressure of the diaphragm driving fluid is based on the amount of the diaphragm driving fluid adsorbed by the adsorbent, but is not so influenced by the temperature of the refrigerant vapor introduced into the space of the valve member driving unit, located near to the second passage, through the pressure equalizing opening.

Further, in the first thermostatic expansion valve of this invention structured as described above, diaphragm driving fluid which has not been gasified yet is adsorbed by the adsorbent. Even if the thermostatic expansion valve of this invention is used in the car air conditioner, therefore, the diaphragm driving fluid which has not been gasified can be more effectively prevented from moving out from the adsorbent (that is, the extending end portion of the chamber located in the portion of the valve member driving rod which is exposed in the second passage) while vibration, centrifugal force, acceleration and deceleration is applied to the car which accommodates the air conditioner while the car is moving. This makes the first thermostatic expansion valve operate normally.

Further, since the first thermostatic expansion valve of this invention has the independent pressure equalizing opening, the thermostatic expansion valve can be used together with the evaporator pressure regulator in such an arrangement that the evaporator pressure regulator is arranged in the refrigerant pipe between the refrigerant outlet of the second passage of the thermostatic expansion valve and the compressor and the pressure equalizing opening is connected to the refrigerant pipe in the downstream side of the evaporator pressure regulator. With such arrangement described above, the first thermostatic expansion valve of this invention can operates in the same way as in the conventional thermostatic expansion valve having the thermal bulb and being used together with the evaporator pressure regulator. That is, when the evaporator pressure regulator closes the refrigerant pipe, the pressure difference between the pressure of the gas generated by the diaphragm driving fluid in the extending end portion of the chamber in the valve member driving rod located upstream side of the evaporator pressure regulator, and the pressure of the refrigerant vapor flowing through the equalizing opening from the refrigerant pipe located downstream side of the evaporator pressure regulator becomes large. Thus, the thermostatic expansion valve is opened more largely to increase the amount of the refrigerant liquid flowing into the evaporator. This prevents the temperature of the evaporator from being lowered.

In the above-described first thermostatic expansion valve according to the present invention, it is preferable that the sealing means includes an O-ring which supports the valve member driving rod freely slidable along the center line at the first supporting portion and seals the clearance between the first supporting portion and the valve member driving rod. This sealing means makes a structure for sealing the clearance in the first supporting portion being simpler, so that the volume of the space communicating with the equalizing opening and located near to the second passage in the valve member driving unit can be made as small as possible. Merits obtained in this case are as already described above.

In order to achieve the above described object of the present invention, a second thermostatic expansion valve of this invention comprising: a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion; a valve member arranged in the first passage and being able to contact and separate from an opening of the valve port, the opening being located away from the second passage and being provided with a valve seat; means for urging the valve member toward the valve seat of the valve port; a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid; a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a hole chamber having an opening at the one end, extending in the rod to a portion thereof exposing in the second passage, and closed at its extending end; means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod and a second supporting portion which is located in the valve housing between the second passage and the first passage and supports the valve member driving rod to be freely slidable along the center line; and a porous trap member for trapping the diaphragm driving fluid, and contained in the chamber in the valve member driving rod.

With this structure, since the chamber in which the trap member is contained is extended in the valve member driving rod to a portion thereof exposed in the second passage, temperature of the trap member can correspond to that of the refrigerant vapor flowing from the refrigerant outlet into the second passage. The liquified diaphragm driving fluid in the space of the valve member driving unit which is located away from the second passage is trapped in the trap member. This trapped liquified diaphragm driving fluid is gasified in response to the temperature of the trap member, thereby changing the pressure of gas generated by the diaphragm driving fluid in the space of the valve member driving unit which is located away from the second passage. This change of the gas pressure changes a difference between the gas pressure and the pressure of the refrigerant vapor flowing from the refrigerant outlet of the evaporator into the second passage and introduced into the space located near to the second passage in the valve member driving unit, through the equalizing opening, thereby causing a center portion of the diaphragm to be displaced. This displacement of the center portion of the diaphragm is transmitted to the valve member through the valve member driving rod to change a distance between the valve member and the valve seat of the valve port in the valve housing. As the result of this, an amount of the refrigerant liquid flowing from the refrigerant outlet of the condenser into the refrigerant inlet of the evaporator through the first passage of the valve housing is changed in response to the degree of superheat of the refrigerant vapor flowing out from the refrigerant outlet of the evaporator.

Most of the gas pressure of the diaphragm driving fluid is based on the amount of the diaphragm driving fluid trapped in the trap member, but is not so influenced by the temperature of the refrigerant vapor introduced into the space of the valve member driving unit located near to the second passage, through the pressure equalizing opening. In the second thermostatic expansion valve of this invention structured as described above, the diaphragm driving fluid which has not been gasified is trapped in the trap member. Therefore, if the second thermostatic expansion valve is used in the car air conditioner the diaphragm driving fluid which has not been gasified can be more effectively prevented from flowing out from the trap member (that is, the extending end portion of the chamber in the valve member driving rod which is exposed in the second passage) while vibration, centrifugal force, acceleration and deceleration is applied to the car which accommodates the air conditioner while the car is moving. This makes the second thermostatic expansion valve operate normally.

Further, since the second thermostatic expansion valve described above has the independent pressure equalizing opening, the thermostatic expansion valve can be used together the evaporator pressure regulator.

Also, in the above-described second thermostatic expansion valve, it is preferable that the sealing means includes an O-ring which supports the valve member driving rod freely slidable along the center line at the first supporting portion and seals the clearance between the first supporting portion and the valve member driving rod.

In order to achieve the above described object of the present invention, a third thermostatic expansion valve of this invention comprising: a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion; a valve member arranged in the first passage and being able to contact and separate from an opening of the valve port, the opening being located away from the second passage and being provided with a valve seat; means for urging the valve member toward the valve seat of the valve port; a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid; a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a chamber having an opening at the one end, extending in the rod to a portion thereof exposing in the second passage, and closed at its extending end; means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod and a second supporting portion which is located in the valve housing between the second passage and the first passage and supports the valve member driving rod to be freely slidable along the center line; and an adsorbent filled in the chamber in the valve member driving rod and changing an adsorbing amount of the diaphragm driving fluid in response to change in temperature thereof; wherein the sealing means includes a collar member interposed between the first supporting portion and the valve member driving rod to enclose an outer peripheral surface of the valve member driving rod and to be freely slidable along the center line relative to the first supporting portion and the valve member driving rod, an O-ring attached to an outer peripheral surface of the collar member to seal a clearance between the outer peripheral surface of the collar member and the first supporting portion, and another O-ring attached to an inner peripheral surface of the collar member to seal a clearance between the inner peripheral surface of the collar member and the outer peripheral surface of the valve member driving rod.

This third thermostatic expansion valve can perform the same function as that performed by the first thermostatic expansion valve comprising the adsorbent. Further, since the sealing means has the above described structure, the O-ring for sealing the clearance between the inner peripheral surface of the collar member and the outer peripheral surface of the valve member driving rod can be positioned as near to the diaphragm as possible in the space of the valve member driving unit which is located near to the second passage. With this structure, the volume of the space of the driving unit which is located near to the second passage can be made smaller, as compared with that of the above described first thermostatic expansion valve comprising the adsorbent. Merits obtained in this case are as already mentioned above.

In order to achieve the above described object of the present invention, a fourth thermostatic expansion valve comprising: a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion; a valve member arranged in the first passage and being able to contact and separate from an opening of the valve port, the opening being located away from the second passage and being provided with a valve seat; means for urging the valve member toward the valve seat of the valve port; a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid; a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a chamber having an opening at the one end, extending in the rod to a portion thereof exposing in the second passage, and closed at its extending end; means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod and a second supporting portion which is located in the valve housing between the second passage and the first passage and supports the valve member driving rod to be freely slidable along the center line; and a porous trap member for trapping the diaphragm driving fluid, and contained in the chamber in the valve member driving rod; wherein the sealing means includes a collar member interposed between the first supporting portion and the valve member driving rod to enclose an outer peripheral surface of the valve member driving rod and to be freely slidable along the center line relative to the first supporting portion and the valve member driving rod, an O-ring attached to an outer peripheral surface of the collar member to seal a clearance between the outer peripheral surface of the collar member and the first supporting portion, and another O-ring attached to an inner peripheral surface of the collar member to seal a clearance between the inner peripheral surface of the collar member and the outer peripheral surface of the valve member driving rod.

This fourth thermostatic expansion valve structured as described above can perform the same function as that performed by the above described second thermostatic expansion valve comprising the trap member. Further, merits obtained by the sealing means including the collar member and the two O-rings are the same as those obtained by the third thermostatic expansion valve having the same sealing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

First Embodiment

Figure 1:
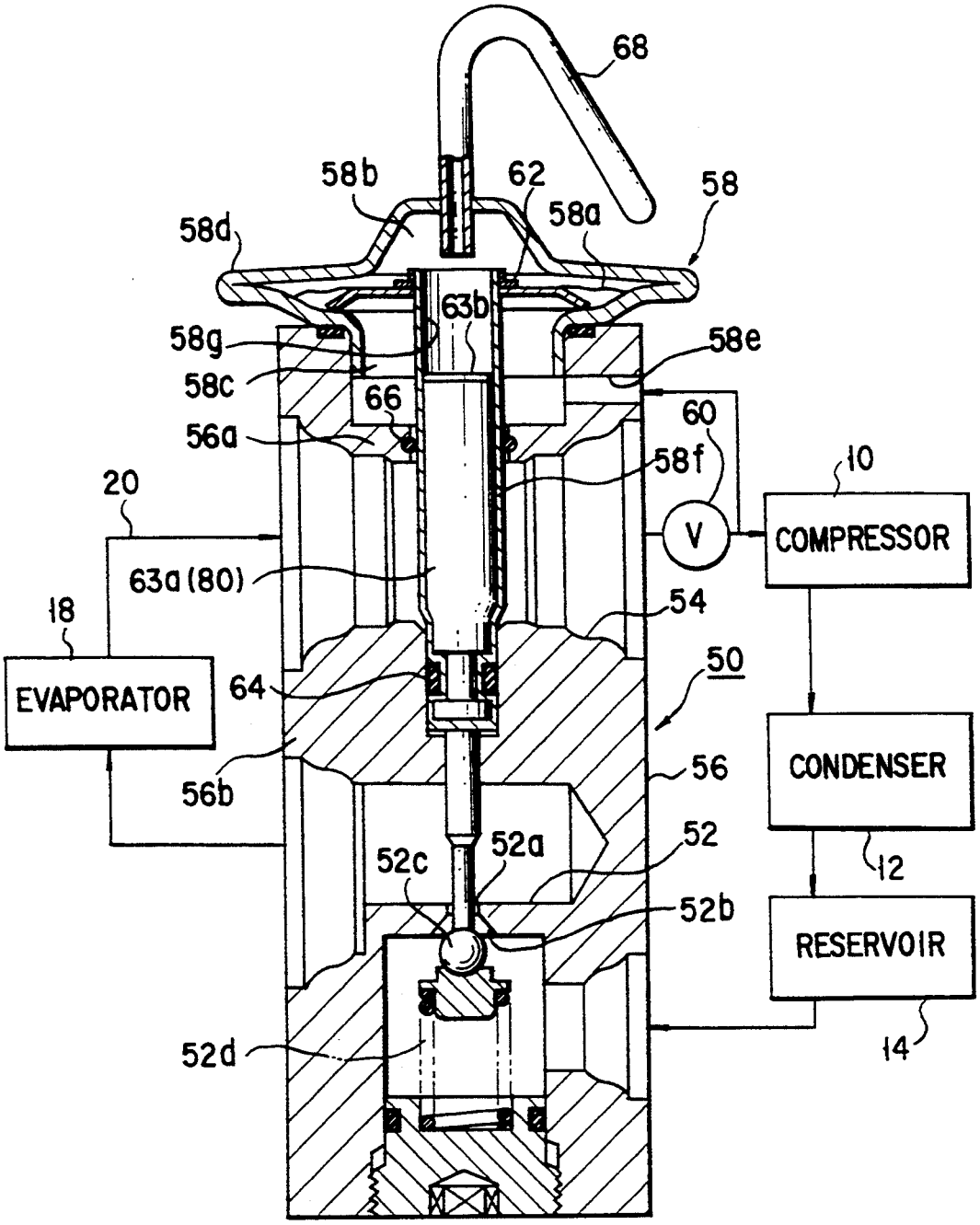
FIG. 1 is a longitudinally-sectional view schematically showing a thermostatic expansion valve according to a first embodiment of the present invention.

FIG. 1 is a longitudinally-sectional view showing a thermostatic expansion valve according to a first embodiment of the present invention.

This thermostatic expansion valve 50 has a valve housing 56 having first and second passages 52 and 54 separated from each other in the vertical direction. The valve housing 56 is attached to a refrigerant pipe 20 connecting a compressor 10, a condenser 12, a reservoir 14 and an evaporator 18 to one another in this order, with the first passage 52 being interposed between a refrigerant outlet of the reservoir 18 and a refrigerant inlet of the evaporator 18, and the second passage 54 being interposed between a refrigerant outlet of the evaporator 18 and a refrigerant inlet of the compressor 10.

A valve port 52*a* is formed in the first passage 52 to make a refrigerant liquid supplied from the refrigerant outlet of the reservoir 14, perform an adiabatic expansion. The valve port 52*a* has a center line extending in a longitudinal direction (vertical direction in FIG. 1) of the valve housing 56. A valve seat 52*b* is formed on an inlet of the valve port 52*a* and a valve member 52*c* is urged toward the valve seat 52*b* by an urging means 52*d*, such as for example a comparison coil spring.

A unit 58 for driving the valve member 52*c* is attached to a top end of the valve housing 56. The valve member driving unit 58 has a pressure-operativing housing 58*d* having upper and lower pressure-operativing chambers 58*b* and 58*c* partitioned by a diaphragm 58*a*.

The lower pressure-operating chamber 58*c* in the pressure-operating housing 58*d* is connected to the refrigerant pipe 20 between a refrigerant outlet of the second passage 54 and the refrigerant inlet of the compressor 10 through a pressure equalizing opening 58*e* which is arranged independently of the second passage 54.

In this embodiment, an evaporator pressure regulator 60 is attached to the refrigerant pipe 20 between the refrigerant outlet of the second passage 54 and a connecting point of the pressure equalizing opening 58*e* to the refrigerant pipe 20.

A valve member driving rod 58*f* extends concentrically in the valve housing 56 from a lower surface of the diaphragm 58*a* to the valve port 52*a* of the first passage 52 along the center line of the valve port 52*a*. An upper end of the driving rod 58*f* is air-tightly fixed to a center portion of the diaphragm 58*a* by means of a flange 62. With the driving rod 58*f* extending from its top end to its lower end, it passes at first through the lower pressure-operating chamber 58*c* in the pressure-operating housing 58*d*. The driving rod 58*f* is then supported freely slidable along the center line in the vertical direction by a partition wall 56*a* between the lower pressure-operating chamber 58*c* in the pressure-operating housing 58*d* and the second passage 54. The driving rod 58*f* further crosses the second passage 54 and it is then supported freely slidable along the center line in the vertical direction by a partition wall 56*b* between the second passage 54 and the first passage 52. The driving rod 58*f* still further crosses the first passage 52 and terminates in the valve port 52*a*. To the lower end of the driving rod 58*f* the valve member 52*c* which is urged toward the valve seat 52*b* in the valve port 52*a* by the urging means 52*d* is abutted.

In the valve member driving rod 58*f*, a chamber 58*g* is formed to extend from the upper end thereof to a portion thereof which corresponds to the partition wall 56*b* between the second passage 54 and the first passage 52. This chamber 58*g* has an opening at the top end of the driving rod 58*f*.

The chamber 58*g* is filled with an adsorbent 63*a* from a bottom end thereof to a portion near the open top end thereof. The adsorbent 63*a* is formed by, for example activated carbon, and is capped by a metal net or porous lid 63*b* so that the adsorbent 63*a* is prevented from jumping out of the hole 58*g* through its open top end when vibration, centrifugal force, acceleration and deceleration are added to the temperature expansion valve 50.

A well-known sealing member 64 such as an O-ring is attached to a portion of an outer peripheral surface of the valve member driving rod 58*f* which opposes the partition wall 56*b* between the second passage 54 and the first passage 52. This sealing member 64 allows the valve member driving rod 58*f* to move slidably up and down in the partition wall 56*b* along the center line of the valve port 52*a* but prevents the refrigerant fluid from leaking out from the second passage 54 to the first passage 52 and vice versa through a clearance between the rod 58*f* and the partition wall 56*b*.

Another sealing member 66 such as an O-ring is attached to the partition wall 56*a* between the lower pressure-operating chamber 58*c* in the pressure-operating housing 58*d* and the second passage 54. This sealing member 66 allows the valve member driving rod 58*f* to move slidably up and down in the partition wall 56*a* along the center line of the valve port 52*a* but prevents the refrigerant fluid from leaking out from the second passage 54 to the lower pressure-operating chamber 58*d* and vice versa through a clearance between the partition wall 56*a* and the rod 58*f*.

A predetermined amount of well-known diaphragm driving fluid such as HFC23 is filled in the upper pressure-operating chamber 58*b* in the pressure-operating housing 58*d* through a tube 68 in a manufacturing line of the thermostatic expansion valve. When the filling of the diaphragm driving fluid is finished, an open end of the tube 68 is pressed and closed.

It will be described how the above-described thermostatic expansion valve 50 according to the first embodiment of the present invention is operated.

The adsorbent 63*a* contained in the valve member drive rod 58*f* so as to be arranged in the second passage 54 changes an adsorbing amount of the diaphragm driving fluid in directly response to a temperature of a refrigerant vapor flowing from the refrigerant outlet of the evaporator 18 into the second passage 54. This causes a pressure of gas generated in the upper pressure-operating chamber 58*b* by the diaphragm driving fluid to be changed.

A center portion of the diaphragm 58*e* in the valve member driving unit 58 is displaced up or down by a difference between a pressure of gas generated in the upper pressure-operating chamber 58*b* by the diaphragm driving fluid and a pressure of the refrigerant vapor introduced into the lower pressure-operating chamber 58*c* from the refrigerant pipe 20 between the evaporator pressure regulator 60 and the refrigerant inlet of the compressor 10 through the pressure equalizing opening 58*e*. This displacement of the diaphragm 58*a* is transmitted to the valve member 52*c* via the valve member driving rod 58*f*, and the valve member 52*c* approaches or moves away from the valve seat 52*b* in the valve hole 52*a* with or against the urging force of the urging means 52*d*. As a result of this, the amount of the refrigerant liquid flowing from the refrigerant outlet of the reservoir 14 into the refrigerant inlet of the evaporator 18 through the first passage 52 in the valve housing 56 is changed on the basis of the degree of superheat of the refrigerant vapor (which corresponds to heat load applied to the evaporator 18) flowing out from the refrigerant outlet of the evaporator 18.

Let us now consider a case where heat load applied to the evaporator 18 becomes small and the temperature of the refrigerant vapor flowing from the refrigerant outlet of the evaporator 18 into the second passage 54 is thus lowered to reach the predetermined value and where the pressure of the refrigerant vapor which corresponds to the temperature of the refrigerant vapor reaches the predetermined value at which the evaporator pressure regulator 60 starts its operation to close the refrigerant pipe 20.

The pressure of the refrigerant vapor introduced from the refrigerant pipe 20 into the lower pressure-operating chamber 58*c* through the pressure equalizing hole 58*e* is rapidly lowered when the refrigerant pipe 20 is closed by the evaporator pressure regulator 60. However, the pressure of gas generated in the upper pressure-operating chamber 58*b* by the diaphragm driving fluid is not lowered because the gas pressure corresponds to the temperature of the refrigerant fluid flowing from the refrigerant outlet of the evaporator 18 into the second passage 54. Therefore, the difference between the gas pressure in the upper pressure-operating chamber 58*b* and the pressure in the lower pressure-operating chamber 58*c* becomes larger. The center portion of the diaphragm 58*a* is thus rapidly displaced downward, thereby causing the valve member driving rod 58*f* to move away the valve member 52*c* from the valve seat 52*b* in the valve hole 52 against the urging force of the urging means 52*d*. As the result of this, the amount of the refrigerant liquid flowing from the refrigerant outlet of the reservoir 14 into the refrigerant inlet of the evaporator 18 through the first passage 52 in the valve housing 56 becomes larger, irrespective of the heat load applied to the evaporator 18. The refrigerant liquid of the increased amount flowing into the evaporator 18 can thus efficiently prevent the temperature of the evaporator 18 from being lowered, and can also efficiently prevent frost from being formed on the outer surface of the evaporator 18.

In the first embodiment of the present invention, the pressure of the gas generated by the diaphragm driving fluid is influenced a little by the temperature of the refrigerant vapor introduced into the lower pressure-operating chamber 58*c* through the pressure equalizing hole 58*e* but mostly by the amount of the diaphragm driving fluid adsorbed in the adsorbent 63*a*.

Further, the diaphragm driving fluid which has not gasified is adsorbed by the adsorbent 63*a* in the thermostatic expansion valve 50. Even if the thermostatic expansion valve 50 is used in a refrigeration cycle for a car air conditioner, therefore, the diaphragm driving fluid which has not gasified can be effectively prevented from moving out from the adsorbent 63*a* (that is, the extending end portion of the hole 58*g* corresponding to the portion of the valve member driving rod 58*f* which is exposed in the second passage 54), while the car accommodating the air conditioner moves and vibration, centrifugal force, acceleration and deceleration is applied to the car. The thermostatic expansion valve 50 can perform normally.

When the temperature of the refrigerant vapor flowing from the refrigerant outlet of the evaporator 18 into the second passage 54 changes, a response speed of a liquid-gas equilibrium pressure is quick, but that of a gas adsorption-emission equilibrium is slower than the former one. Therefore, in this embodiment, the valve opening and closing can have predetermined time constants, respectively, so that a hunting phenomenon is prevented effectively from generating in this expansion valve.

Still further, when the thermostatic expansion valve 50 having the individual equalizing hole 58*e* is used in the refrigeration cycle in combination with the evaporator pressure regulator 60, the evaporator pressure regulator 60 can be attached to the refrigerant pipe 20 between the refrigerant outlet of the second passage 54 and the point at which the pressure equalizing opening 58*e* is connected to the refrigerant pipe 20. With this arrangement, the thermostatic expansion valve 50 can function in the same way as that in the above described conventional thermostatic expansion valve which has the independent thermal bulb and which is used in the refrigeration cycle in combination with the evaporator pressure regulator.

Still further, the well-known sealing member 66 such as the O-ring is attached to the partition wall 56*a* of the valve housing 56 between the lower pressure-operating chamber 58*c* in the pressure-operating housing 58*d* and the second passage 54. The sealing member 66 allows the valve member driving rod 58*f* to move freely and slidably up and down in the partition wall 56*a* along the center line of the valve port 52*a* but prevents the refrigerant fluid from leaking from the second passage 54 into the lower pressure-operating chamber 58*c* in the pressure-operating housing 58*d* and vice versa through the clearance between the partition wall 56*a* and the valve member driving rod 58*f*.

This sealing member 66 makes a structure of sealing means in the partition wall 56*a* being simple. Therefore, the volume of the lower pressure-operating chamber 58*c* communicated with the pressure equalizing opening 58*e* in the valve member driving unit 58 can be made as small as possible. This is preferable because the pressure of the gas generated in the upper pressure-operating chamber 58*b* by the diaphragm driving fluid is influenced more or less by the heat of the refrigerant vapor in the lower pressure-operating chamber 58*c* via the diaphragm 58*a* and the valve member driving rod 58*f*.

Second Embodiment

A thermostatic expansion valve 70 according to a second embodiment of the present invention will be described in detail with reference to FIG. 2.

Most structural elements of the thermostatic expansion valve 70 are the same as those in the thermostatic expansion valve 50 described above. Therefore, they will be denoted by the same reference numerals as those denoting the same structural elements in the latter expansion valve 50, and detailed descriptions thereof will be omitted.

In the followings, only structures which are different from those in the thermostatic expansion valve 50 will be described in detail. In the second embodiment, a ring-shaped collar member 72 is interposed between the partition wall 56*a*, which is located between the lower pressure-operating chamber 58*c* in the pressure-operating housing 58*d* and the second passage 54, and the portion of the valve member driving rod 58*f*, which corresponds to the partition wall 56*a*. The collar member 72 encloses the portion of the driving rod 58*f* and can freely slide up and down along the center line of the valve port 52*a* and relative to the inner peripheral surface of the partition wall 56*a* and the portion of the outer peripheral surface of the valve member driving rod 58*f* which corresponds to the partition wall 56*a*.

A first well-known sealing member 74 such as an O-ring is attached to an outer peripheral surface of the collar member 72 to allow the collar member 72 to slide on the inner peripheral surface of the partition wall 56*a* but prevent the refrigerant fluid from leaking from the second passage 54 into the lower pressure-operating chamber 58*c* in the pressure-operating housing 58*d* and vice versa through a clearance between the outer peripheral surface of the collar member 72 and the inner peripheral surface of the partition wall 56*a*. Further, a second well-known sealing member 76 such as an O-ring is attached to the inner peripheral surface of the collar member 72 to allow the collar member 72 to slide on the outer peripheral surface of the valve member driving rod 58*f* but prevent the refrigerant fluid from leaking from the second passage 54 into the lower pressure-operating chamber 58*c* in the pressure-operating housing 58*d* and vice versa through a clearance between the outer peripheral surface of the valve member driving rod 58*f* and the inner peripheral surface of the collar member 72.

The thermostatic expansion valve 70 can operate in the same way and obtain the same advantage as those in the first one 50. In addition, the particular combination of the collar member 72 and the first and second sealing members 74 and 76 can provide the following merit.

When a position of the second sealing member 76 is moved up and down along the inner peripheral surface of the collar member 72, the volume of the lower pressure-operating chamber 58*c* in the pressure-operating housing 58*d* can be changed. This volume can be made smaller than that in the first thermostatic expansion valve 50 by attaching the second sealing member 76 to a top end portion of the collar member 72 because the top end of the collar member 72 is positioned just under the lower surface of the diaphragm 58*a*. The advantage obtained by making the volume being smaller is as already described above.

Further, it is easier that the volume of the lower pressure-operating chamber 58*c* is set to have such a value that allows the thermostatic expansion valve 70 to function as desired.

Variations of First and Second Embodiments

Figure 2:
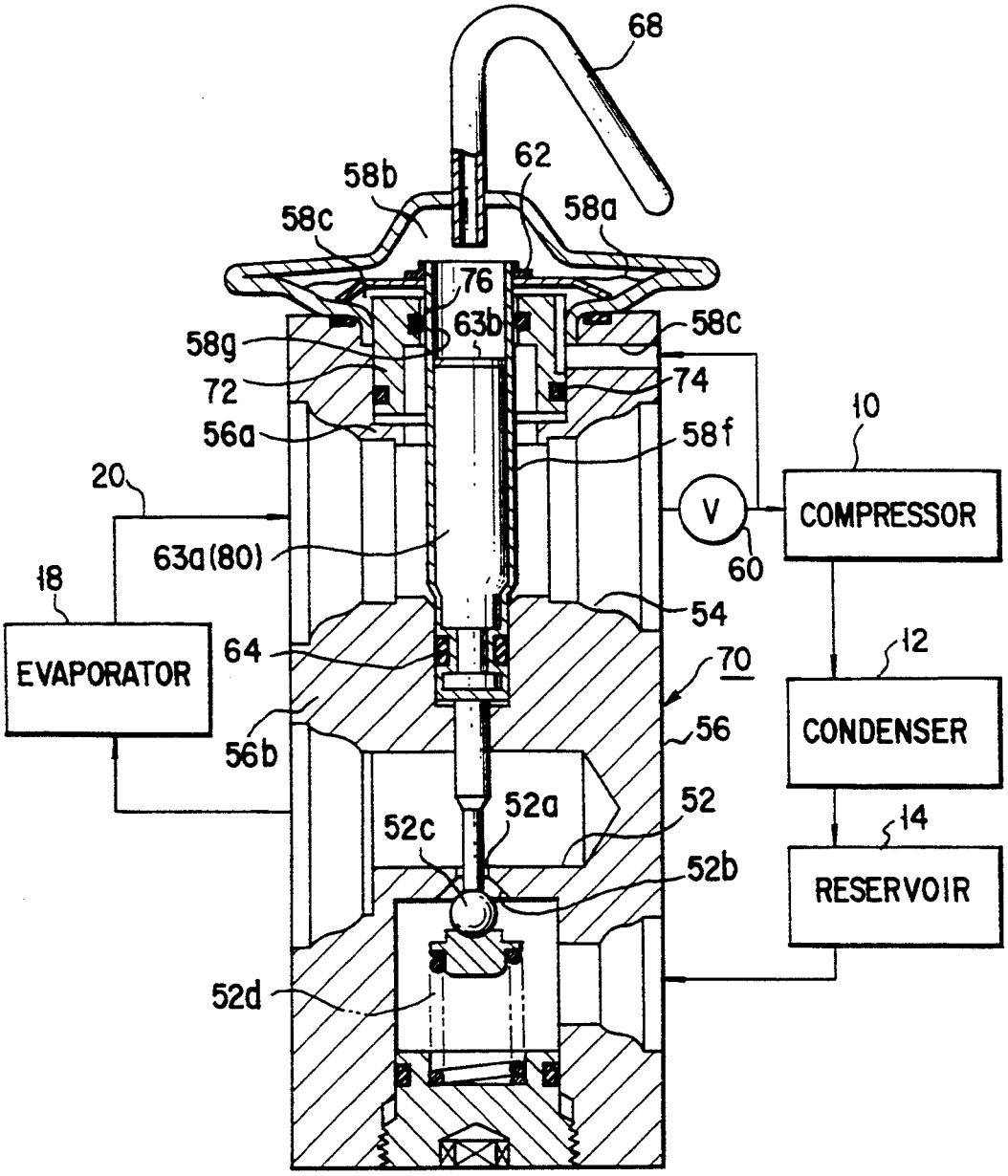
FIG. 2 is a longitudinally-sectional view schematically showing a thermostatic expansion valve according to a second embodiment of the present invention.
Figure 3:
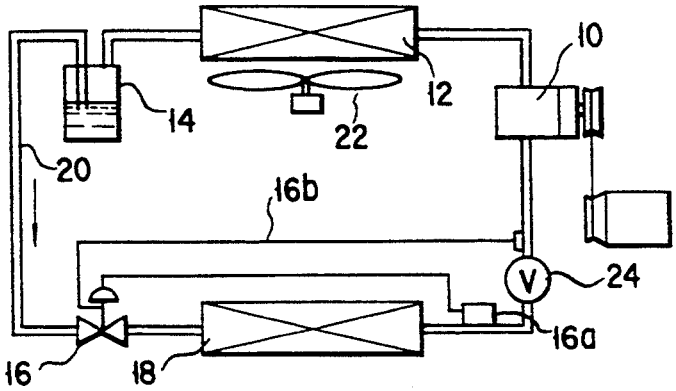
F I G. 3 PRIOR ART
FIG. 3 schematically shows a conventional thermostatic expansion valve which has an independent thermal bulb, is used together with an evaporator pressure regulator in a refrigeration cycle, the thermostatic expansion valve being not suitable to be used in a car air conditioner needed to be small in size and light in weight.
Figure 4:
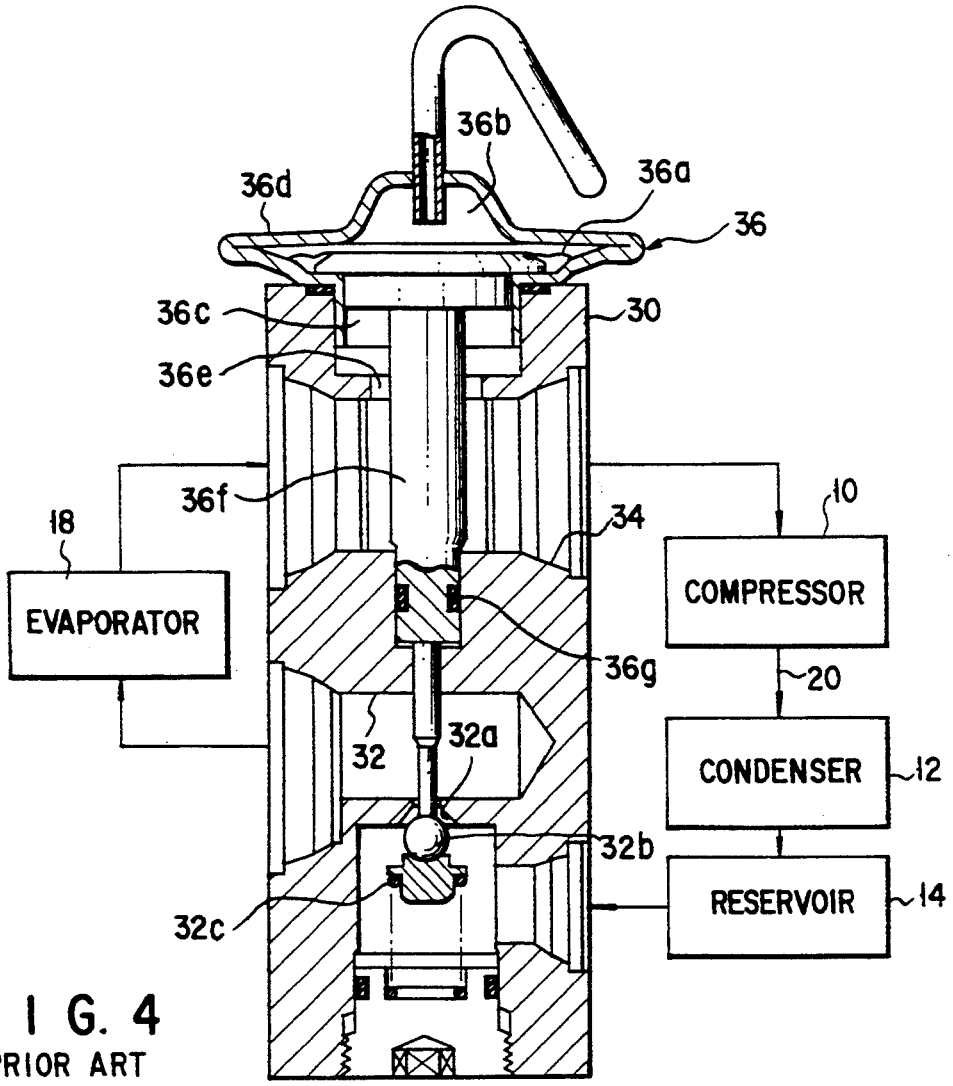
F I G. 4 PRIOR ART
FIG. 4 is a longitudinally-sectional view schematically showing another conventional thermostatic expansion valve which is small in size and light in weight, is used in a car air conditioner and is not suitable to be used together with an evaporator pressure regulator.

Instead of the adsorbent 63*a*, a porous trap member 80 for trapping the diaphragm driving fluid can be used in both of the first and second thermostatic expansion valves 50 and 70 shown in FIGS. 1 and 2. The trap member 80 has numerous micro pores. The porous trap members 80 of these variations is structured by for example silica-aluminum sintered material. The details of these trap members 80 are disclosed in U.S. Pat. No. 5,044,551, issued to one of the inverters of this application.

In the numerous micro pores of the trap member 80, the diaphragm driving fluid which is filled in the upper pressure-operating chamber 58*b* and which is not gasified yet is trapped. The heat of the refrigerant vapor in the second passage 54 in which the valve member driving rod 58*f* is exposed is transmitted directly to the trap member 80 through the peripheral wall of the valve member driving rod 58*f*. The diaphragm driving liquid trapped in the numerous micro pores of the trap member 80 is gasified in response to the heat of the refrigerant vapor, and increases the pressure of the gas in the upper pressure-operating chamber 58*b*.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A thermostatic expansion valve comprising:

a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion;

a valve member arranged in the first passage and being able to be contact and separate from an opening of the valve port, the opening being located away from the second passage and being provided with a valve seat;

means for urging the valve member toward the valve seat of the valve hole;

a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid;

a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a chamber having an opening at the one end, extending in the rod to a portion thereof exposing in the second passage, and closed at its extending end;

means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod a second supporting portion which is located in the valve housing between the second passage and the first passage and supports the valve member driving rod to be freely slidable along the center line; and an adsorbent filled in the hole of the valve member driving rod and changing an adsorbing amount of the diaphragm driving fluid in response to change in temperature thereof.

2. A thermostatic expansion valve according to claim 1, wherein the sealing means includes an O-ring which supports the valve member driving rod freely slidable along the center line at the first supporting portion and seals the clearance between the first supporting portion and the valve member driving rod.

3. A thermostatic expansion valve comprising:

a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion;

a valve member arranged in the first passage and being able to contact and separate from an opening of the valve port, the opening being located away from the second passage and being provided with a valve seat;

means for urging the valve member toward the valve seat of the valve port;

a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid;

a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a chamber having an opening at the one end, extending in the rod to a portion thereof exposing in the second passage, and closed at its extending end;

means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod and a second supporting portion which is located in the valve housing between the second passage and the first passage and supports the valve member driving rod to be freely slidable along the center line; and a porous trap member for trapping the diaphragm driving fluid, and contained in the chamber in the valve member driving rod.

4. A thermostatic expansion valve according to claim 3, wherein the sealing means includes an O-ring which supports the valve member driving rod freely slidable along the center line at the first supporting portion.

5. A thermostatic expansion valve comprising:

a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion;

a valve member arranged in the first passage and being able to contact and separate from an opening of the valve port, the opening being located away from the second passage and being provided with a valve seat;

means for urging the valve member toward the valve seat of the valve port;

a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid;

a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a chamber having an opening at the one end, extending in the rod to a portion thereof exposing in the second passage, and closed at its extending end;

means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod and a second supporting portion which is located in the valve housing between the second passage and the first passage and supports the valve member driving rod to be freely slidable along the center line; and an adsorbent filled in the chamber in the valve member driving rod and changing an adsorbing amount of the diaphragm driving fluid in response to change in temperature thereof;

wherein the sealing means includes a collar member interposed between the first supporting portion and the valve member driving rod to enclose an outer peripheral surface of the valve member driving rod and to be freely slidable along the center line relative to the first supporting portion and the valve member driving rod, an O-ring attached to an outer peripheral surface of the collar member to seal a clearance between the outer peripheral surface of the collar member and the first supporting portion, and another O-ring attached to an inner peripheral surface of the collar member to seal a clearance between the inner peripheral surface of the collar member and the outer peripheral surface of the valve member driving rod.

6. A thermostatic expansion valve comprising:

a valve housing including a first passage attached to a refrigerant pipe circulating through a compressor, a condenser, and an evaporator, between a refrigerant outlet of the condenser and a refrigerant inlet of the evaporator, and a second passage separated from the first passage and attached to the refrigerant pipe between a refrigerant outlet of the evaporator and a refrigerant inlet of the compressor, the first passage being provided with a valve port having a center line which crosses the second passage, and making refrigerant liquid flowing from the refrigerant outlet of the condenser into the first passage perform an adiabatic expansion;

a valve member arranged in the first passage and being able to contact and separate from an opening of the valve port, the opening being located away from the second passage and being provided with a valve seat;

means for urging the valve member toward the valve seat of the valve port;

a valve member driving unit attached to a portion of the valve housing at which the center line passes and which is located in an opposing side of the first passage in relation to the second passage, and having two spaces therein partitioned by a diaphragm which crosses the center line, a space of the valve member driving unit which is positioned near to the second passage being connected through a pressure equalizing opening to the refrigerant passage between a portion of the second passage at which the center line passes and the compressor, and the other space thereof which is positioned away from the second passage being filled with diaphragm driving fluid;

a valve member driving rod extending along the center line from the space of the valve member driving unit which is located near to the second passage to the valve port in the first passage, and crossing the second passage, the valve member driving rod being supported by the valve housing to be freely slidable along the center line, having one end fixed to the diaphragm and the other end inserted into the valve port of the first passage and contacting the valve member, and being provided with a chamber having an opening at the one end, extending in the rod to a portion thereof exposing in the second passage, and closed at its extending end;

means for sealing a clearance between the valve member driving rod and a first supporting portion which is located in the valve housing between the second passage and the space of the valve member driving unit located near to the second passage and supports the valve member driving rod to be freely slidable along the center line and also for sealing a clearance between the valve member driving rod and a second supporting portion which is located in the valve housing between the second passage and the first passage and supports the valve member driving rod to be freely slidable along the center line; and a porous trap member for trapping the diaphragm driving fluid, and contained in the chamber in the valve member driving rod;

wherein the sealing means includes a collar member interposed between the first supporting portion and the valve member driving rod to enclose an outer peripheral surface of the valve member driving rod and to be freely slidable along the center line relative to the first supporting portion and the valve member driving rod, an O-ring attached to an outer peripheral surface of the collar member to seal a clearance between the outer peripheral surface of the collar member and the first supporting portion, and another O-ring attached to an inner peripheral surface of the collar member to seal a clearance between the inner peripheral surface of the collar member and the outer peripheral surface of the valve member driving rod.

* * * * *

UNITED STATES PATENT AND TRADEMARK OFFICE

CERTIFICATE OF CORRECTION

PATENT NO. : 5,361,597

DATED : Nov. 8, 1994

INVENTOR(S) : Tanaka HAZIME et al.

It is certified that error appears in the above-indentified patent and that said Letters Patent is hereby corrected as shown below:

| Col. | Line | |
|---|---|---|
| 1 | 8 | Change "example in an car" to --example, in a car--. |
| 1 | 9 | Change "being needed" to --required--. |
| 1 | 10 | Delete "also being". |
| 1 | 23 | Change "send" to --sends--. |
| 1 | 31 | Change "are" to --is--. |
| 1 | 44 | After "20" delete "at a". |
| 1 | 48 | After "16a" delete "to". |
| 2 | 50 | Before "difficult" delete "being". |
| 2 | 63 | After "stream" delete "side". |

UNITED STATES PATENT AND TRADEMARK OFFICE

CERTIFICATE OF CORRECTION

PATENT NO. : 5,361,597

DATED : Nov. 8, 1994

INVENTOR(S) : Tanaka HAZIME et al.

It is certified that error appears in the above-indentified patent and that said Letters Patent is hereby corrected as shown below:

| Col. | Line | |
|---|---|---|
| 3 | 4 | After "extends" insert --in--. |
| 4 | 13 | After "32*b*" insert --to--. |
| 4 | 24 | Change "lowering" to --dropping--. |
| 4 | 26 | Change "is lowered" to --is reduced--. |
| 4 | 34 | Change "lowering" to --dropping--. |
| 4 | 45 | Change "lowering" to --dropping--. |
| 4 | 49 | Delete "as". |
| 4 | 66 | Delete "in". |
| 5 | 54-55 | Before "B/A" insert --ratio--; after "from" change "lowering" to --decreasing--. |

UNITED STATES PATENT AND TRADEMARK OFFICE

CERTIFICATE OF CORRECTION

PATENT NO. : 5,361,597

DATED : Nov. 8, 1994

INVENTOR(S) : Tanaka HAZIME et al.

It is certified that error appears in the above-indentified patent and that said Letters Patent is hereby corrected as shown below:

| Col. | Line | |
|---|---|---|
| 5 | 63 | Change "an" to --a--. |
| 5 | 66 | Change "prevent enough" to --sufficiently prevent--. |
| 6 | 1 | Change "applied with various" to --affected by varying degrees of--. |
| 6 | 18 | Delete "being". |
| 6 | 19 | Change "needed" to --required--. |
| 6 | 25 | Change "comprising:" to --comprises:--. |
| 6 | 65 | Change "exposing" to --exposed--. |
| 7 | 61 | Change "is applied to" to --affect--. |

UNITED STATES PATENT AND TRADEMARK OFFICE

CERTIFICATE OF CORRECTION

PATENT NO. : 5,361,597

DATED : Nov. 8, 1994

INVENTOR(S) : Tanaka HAZIME et al.

It is certified that error appears in the above-indentified patent and that said Letters Patent is hereby corrected as shown below:

| Col. | Line | |
|---|---|---|
| 8 | 20 | Before "downstream" insert --on the--. |
| 8 | 22 | Change "more largely" to --wider--. |
| 8 | 24 | Delete "being". |
| 8 | 25 | Change "lowered" to --dropping--. |
| 8 | 34 | Delete "being". |
| 9 | 15 | Change "exposing" to --exposed--. |
| 10 | 19 | After "together" insert --with--. |
| 10 | 29 | Change "comprising:" to --comprises:--. |
| 11 | 1 | Change "exposing" to --exposed--. |
| 12 | 23 | Change "exposing" to --exposed--. |

UNITED STATES PATENT AND TRADEMARK OFFICE

CERTIFICATE OF CORRECTION

PATENT NO. : 5,361,597

DATED : Nov. 8, 1994

INVENTOR(S) : Tanaka HAZIME et al.

It is certified that error appears in the above-indentified patent and that said Letters Patent is hereby corrected as shown below:

| Col. | Line | |
|---|---|---|
| 13 | 43 | Change "reservoir **18**" to --reservoir **14**--. |
| 13 | 59 | Change "operativing" to --operating--. |
| 13 | 60 | Change "operativing" to --operating--. |
| 15 | 11 | Change "directly" to --direct--. |
| 16 | 7 | Change "being lowered" --dropping--. |
| 16 | 28-29 | Change "is applied to" to --act on--. |
| 17 | 1 | Change "makes" to --allows--. |
| 17 | 2 | Change "being" to --to be--. |
| 18 | 6 | Delete "being". |

UNITED STATES PATENT AND TRADEMARK OFFICE

CERTIFICATE OF CORRECTION

PATENT NO. : 5,361,597

DATED : Nov. 8, 1994

INVENTOR(S) : Tanaka HAZIME et al.

It is certified that error appears in the above-indentified patent and that said Letters Patent is hereby corrected as shown below:

| Col. | Line | |
|---|---|---|
| 18 | 21 | Change "inverters" to --inventors--. |
| 19 | 22 | Change "exposing" to --exposed--. |
| 19 | 31 | After "rod" insert --and--. |

Signed and Sealed this

Thirteenth Day of June, 1995

*Attest:*

*Attesting Officer*

BRUCE LEHMAN

*Commissioner of Patents and Trademarks*